US006379190B1

(12) United States Patent
Prazoff

(10) Patent No.: US 6,379,190 B1
(45) Date of Patent: Apr. 30, 2002

(54) ROPELIGHT CONNECTOR

(76) Inventor: Michael Prazoff, 555 Chabanel St. West Ste #700, Montreal, Quebec (CA), H2N-2J2

( * ) Notice: Subject to any disclaimer, the term of this patent is extended or adjusted under 35 U.S.C. 154(b) by 0 days.

(21) Appl. No.: 09/714,563

(22) Filed: Nov. 17, 2000

(51) Int. Cl.[7] ..... H01R 25/00
(52) U.S. Cl. ..... 439/654; 439/320; 362/249
(58) Field of Search ..... 439/312, 320, 439/650, 654; 362/226, 240, 246, 249, 382

(56) References Cited

U.S. PATENT DOCUMENTS 4,812,956 A * 3/1989 Chen ..... 362/249
5,934,792 A * 8/1999 Camarota ..... 362/249

* cited by examiner

*Primary Examiner*—Khiem Nguyen

(74) *Attorney, Agent, or Firm*—Raymond Y. Chan; David and Raymond Patent Group

(57) ABSTRACT

A ropelight connector adapted for securely connecting two ropelights together includes a first connecting member affixed to a first ropelight and a second connecting member affixed to a second ropelight wherein the first connecting member is detachably connected to the second connecting member. The first connecting member includes a pair of locking sockets and a pair of tubular conductors fittedly received in the locking sockets respectively wherein the tubular conductors are electrically connected to a pair of wires inside the first ropelight. The second connecting member includes a pair of conductive terminals, which are electrically extended from a pair of wires inside the second ropelight, protruded from the second connecting member and a tubular shelter outwardly extended from the second connecting member for protecting the conductive terminals. In which, the conductive terminals are adapted for fittingly inserting into the locking sockets to engage with the tubular conductors respectively for securely connecting the second connecting member with the first connecting member, so as to electrically connecting the first and second ropelights together.

8 Claims, 3 Drawing Sheets

ROPELIGHT CONNECTOR

BACKGROUND OF THE PRESENT INVENTION

1. Field of Invention

The present invention relates to a ropelight, and more particularly to a ropelight connector which facilitates the attachment between two ropelight together, so as to ensure the electrical connection therebetween to prevent a user from being electric shock thereof.

2. Description of Related Arts

Referring to FIG. 1, in order to connect two ropelights 10 together, a connector is used. The conventional connector for connecting two ropelights 10 together comprises a pair of first connecting members 11 each affixed to each end of the ropelight 10 and a second connecting member 12 detachably connected between two first connecting members 11.

As shown in FIG. 1, the first connecting member 11A comprises a pair of tubular conductors 111A longitudinally extended through the first connecting member 11A and electrically extended from two wires 13A disposed in the ropelight 10A respectively. The second connecting member 12A comprises two pairs of rod-like terminals 121A opposedly protruded therefrom wherein each pair of the terminals 121A are adapted for inserting into the two tubular conductors 111A of the first connecting member 11 in such a manner that the second connecting member 12A is capable of connecting between the two first connecting members 11A, so as to electrically connect two ropelights 10A together.

However, the connector cannot securely connect two ropelights 10A together. Since the engagement between the second connecting member 12A and the first connecting member 11A is the terminals 121A and the tubular conductors 111A, the engagement may easy to be detached, especially when a lateral force is applied on the ropelight 10A. The unsafe connection of the ropelights will cause unwanted injury to a user, such as electric shock.

Moreover, the terminals 121A are extended outwardly from the second connecting member 12A, which do not have any protection from the second connecting member 12A, the terminals 121A will easily be damaged by an external force. Thus, the second connecting member 12A becomes an individual part of the connector when it is detached from the first connecting member 11A, such that the second connecting member 12A is easy to loss.

SUMMARY OF THE PRESENT INVENTION

A main object of the present invention is to provide a ropelight connector which can facilitates the attachment of two ropelights.

Another object of the present invention is to provide a ropelight connector which can securely connect two ropelights together to ensure the electrical connection therebetween, so as to prevent a user from being electric shock from the ropelights.

Another object of the present invention is to provide a ropelight connector which comprises a locker for ensuring the attachment of the two ropelights.

Another object of the present invention is to provide a ropelight connector wherein the electrical terminals are well protected by a shelter so as to prevent the terminals from being damaged.

Accordingly, in order to accomplish the above objects, the present invention provides a ropelight connector for connecting a first ropelight and a second ropelight together, comprising:

a first connecting member having a first member head portion and a first member tail portion affixed to an end of the first ropelight wherein a pair of locking sockets is longitudinally formed on the first member head portion and a pair of tubular conductor, which are electrically extended from a pair of wires inside the first ropelight respectively, outwardly protruded from the first member head portion along the locking sockets respectively; and a second connecting member comprising a second member head portion, a second member tail portion affixed to an end of the second ropelight, and a tubular shelter frame integrally extended from the second member head portion wherein a pair of conductive terminals, which are electrically connected to a pair of wires inside the second ropelight, are outwardly extended from the second member head portion and adapted for fittingly inserting into the locking sockets to engage with the tubular conductors respectively for securely connecting the second connecting member with the first connecting member, so as to electrically connecting the first and second ropelights together.

DETAILED DESCRIPTION OF THE PREFERRED EMBODIMENT

Figure 1:
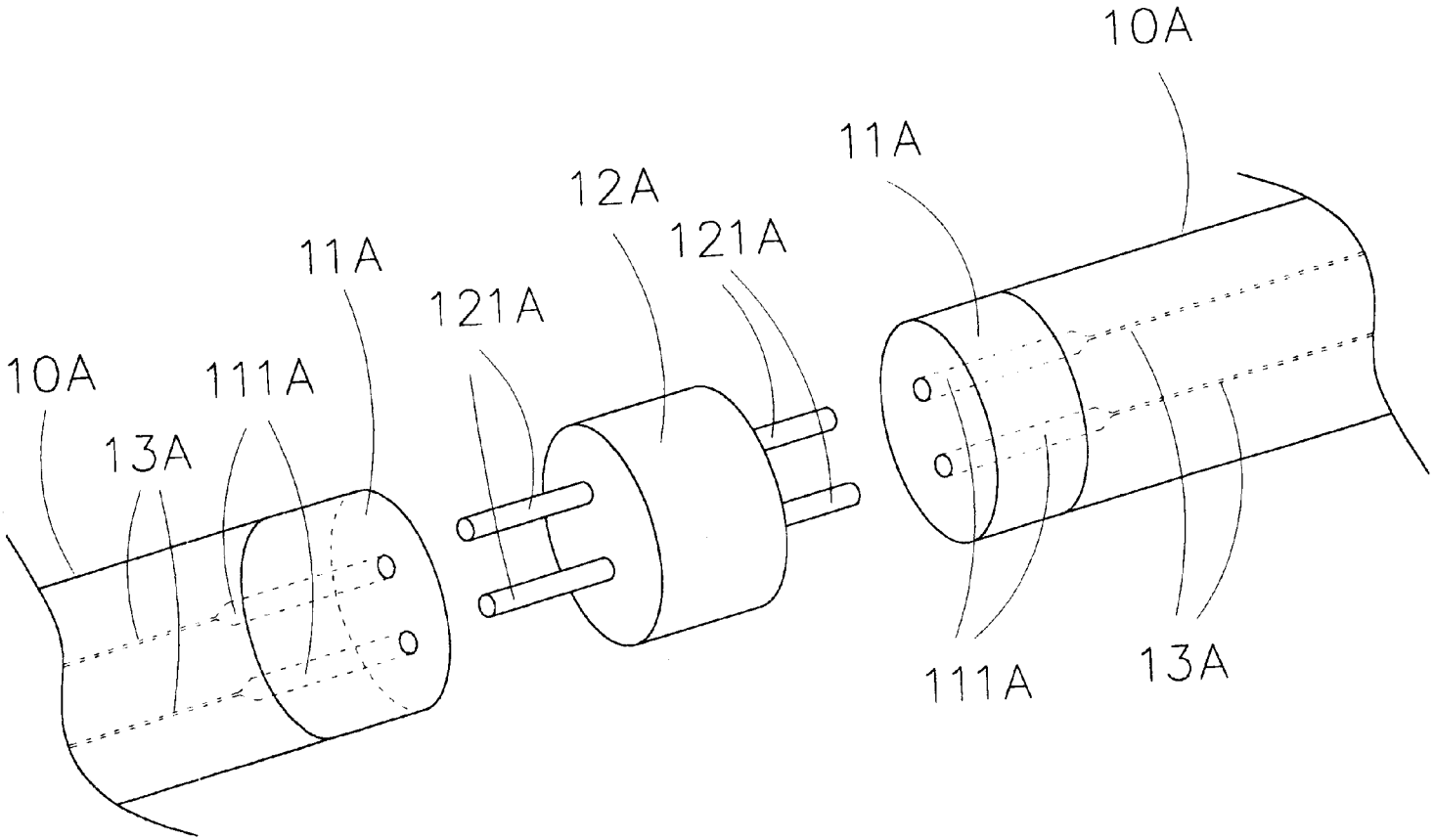
FIG. 1 is a perspective view of a conventional ropelight connector.
Figure 2:
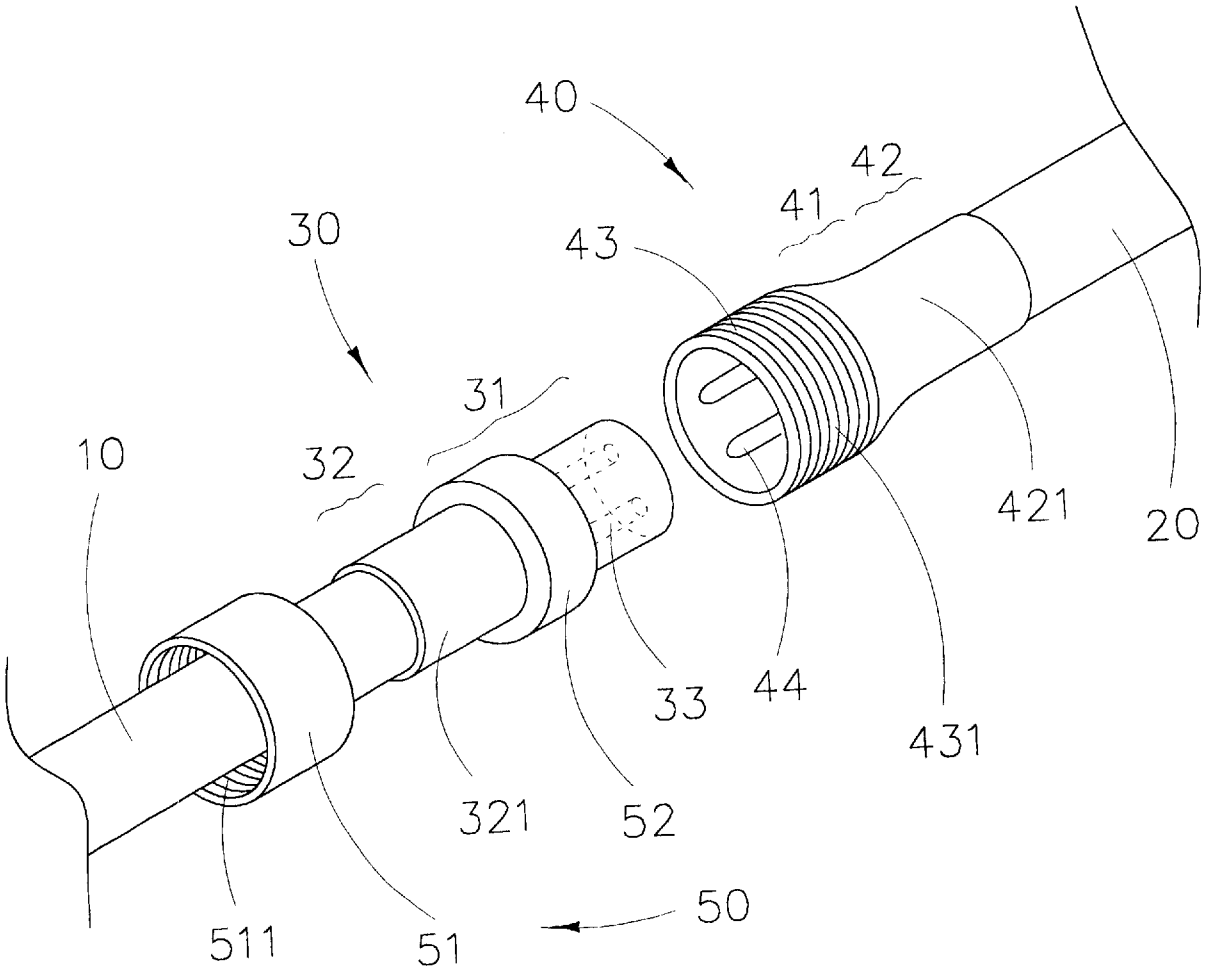
FIG. 2 is a perspective view of a ropelight connector according to a preferred embodiment of the present invention.
Figure 3:
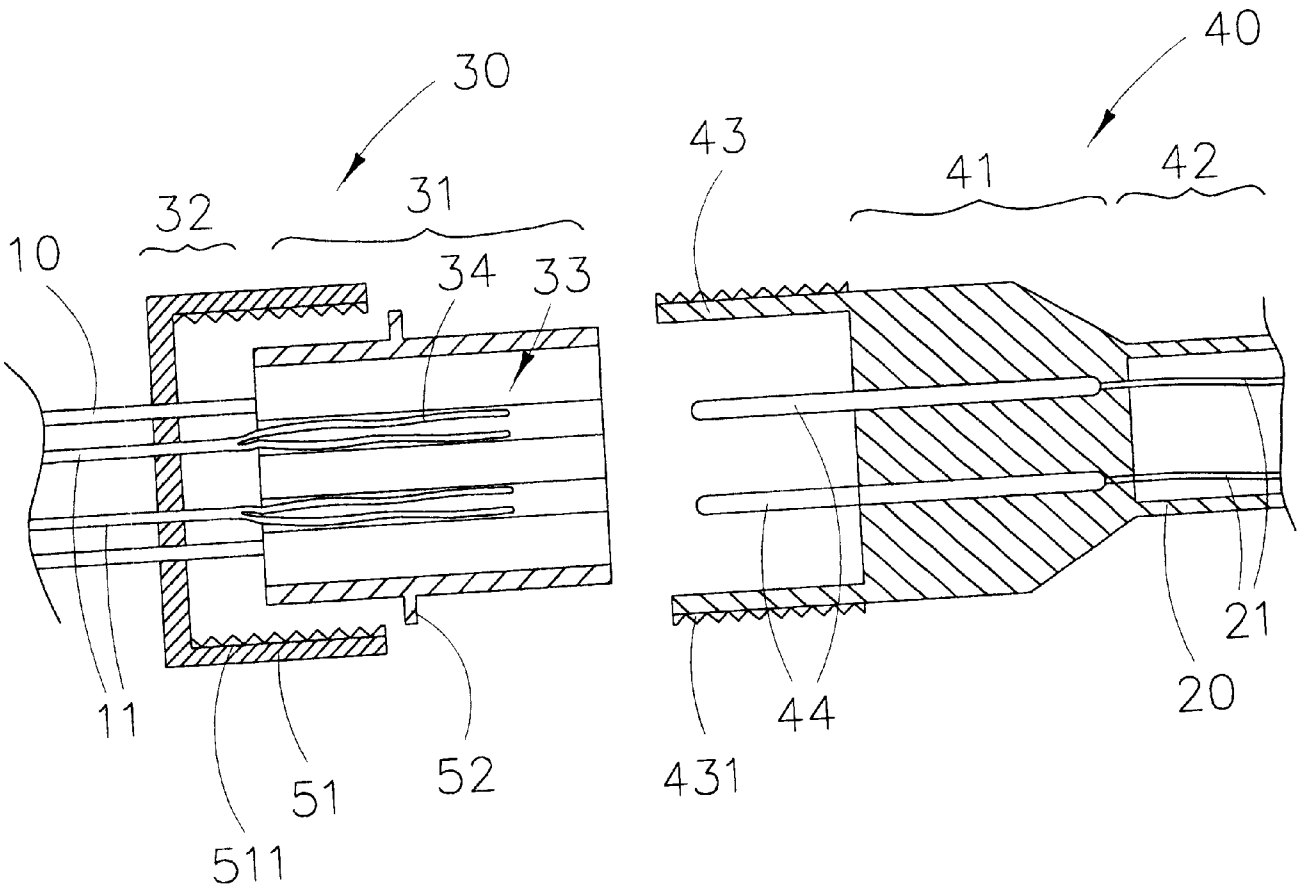
FIG. 3 is a sectional view of the ropelight connector according to the above preferred embodiment of the present invention.

Referring to FIGS. 2 and 3 of the drawings, a ropelight connector according to a preferred embodiment of the present invention is illustrated, wherein the ropelight connector is adapted for securely connecting a first ropelight 10 with a second ropelight 20.

As shown in FIGS. 2 and 3, the ropelight connector comprises a first connecting member 30 and a male member 40 detachably connected to the first connecting member 30.

The first connecting member 30 has a first member head portion 31 and a first member tail portion 32 affixed to an end of the first ropelight 10 wherein a pair of locking sockets 33 is longitudinally formed on the first member tail portion 32 and a pair of tubular conductor 34, which are electrically extended from a pair of wires 11 inside the first ropelight 10, outwardly protruded from the first member head portion 31 along the locking sockets 33 respectively.

The second connecting member 40 has a second member head portion 41, a second member tail portion 42 affixed to an end of the second ropelight 20, and a tubular shelter 43 integrally extended from the second member head portion 41 wherein a pair of conductive terminals 44, which are electrically connected to a pair of wires 21 inside the second ropelight 20, are outwardly extended from the second member head portion 41 and adapted for fittingly inserting into the locking sockets 33 to engage with the tubular conductors 34 respectively for securely connecting the second connecting member 40 with the first connecting member 30, so as to electrically connecting the first and second ropelights 10, 20 together.

According to the preferred embodiment, each of the first and second ropelights 10, 20 is an elongated hollow tube wherein each of the first and second ropelights 10, 20 comprises the pair of wires 11, 21 longitudinally disposed therein in such a manner that when the first ropelight 10 is connected to the second ropelight 20, the wires 11 of the first ropelight 10 is electrically connected with the wires 21 of the ropelight 20.

The head portion 31 of the first connecting member 30 has a cylindrical shape wherein the parallel round-shape locking sockets 33 are longitudinally formed on the head portion 31 of the first connecting member 30. The pair of tubular conductors 34 are fittedly received in the locking sockets 33 wherein rear ends of the tubular conductors 34 are electrically connected to the wires 11 of the first ropelight 10 respectively.

The head portion 41 of the second connecting member 40 also has a cylindrical shape wherein the parallel rod-like conductive terminals 44, which are electrically extended from the wires 21 of the second ropelight 20 respectively, are outwardly protruded from the head portion 41 of the second connecting member 40 in such a manner that the conductive terminals 44 are adapted for fittingly inserting into the locking socket 33 in order to engage with the tubular conductor 34 for electrically connecting the first and second ropelights 10, 20 together.

The tubular shelter 43 is coaxially extended from the second member head portion 41 of the second connecting member 40 and encircling the conductive terminals 44 for protecting the conductive terminals 44. The tubular shelter 43 has a diameter slightly larger than a diameter of the first member head portion 31 of first connecting member 30 such that a head portion 31 of the first connecting member 30 is adapted for fittingly inserting into the tubular shelter 43. It is worth to mention that the tubular shelter 43 can not only protect the conductive terminals 44 but also increase the contacting surface between the first connecting member 30 and the second connecting member 40 since an exterior surface of the first member head portion 31 is frictionally engaged with an interior surface of the tubular shelter 44.

In addition, the tubular shelter 43 has a predetermined depth, which is larger than a length of the first member head portion 31, for fittedly receiving the first member head portion 31 therein. Since the conductive terminals 44 are inserted into the tubular conductors 34 along the locking sockets 33 respectively when connecting the first connecting member 30 with the second connecting member 40, the conductive terminals 44 may over plug into and damage the tubular conductors 34.

The first member tail portion 32 of the first connecting member 30 and the second member tail portion 42 of the second connecting member 40 are respectively tubular holders 321, 421 wherein the tubular holders 321, 421 are securely affixed to the ends of the first and second ropelights 10, 20 in such an air tight manner, so as to firmly connect the first connecting member 30 and the second connecting member 40 to the first ropelight 10 and the second ropelight 20 respectively. Accordingly, each tubular holder 321, 421 has a diameter slightly larger than a diameter of the respective ropelight 10, 20 such that the ends of the first ropelight 10 and the second ropelight 20 are fitted inserted into the tubular holder 321, 421. Preferably, the tubular holders 321, 421 are molded to the first and second ropelights 10, 20 in a permanent connection.

As shown in FIG. 2, the ropelight connector further comprises a locking means 50 for securely locking up the first connecting member 30 with the second connecting member 40, wherein the locking means 50 comprises a ring-shaped sleeve locker 51 adapted for engaging with the second connecting member 40, and a ring-shaped stopper 52 for blocking a radially and inwardly projected end shoulder of the sleeve locker 51 in such a slidably movable manner along the first connecting member 30.

The sleeve locker 51 is slidably worn on to the first connecting member 30 wherein the sleeve locker 51, which has a diameter slightly larger than a diameter of the tubular shelter 43, has an inner threaded portion 511 for screwing with an outer threaded portion 431 of the tubular shelter 43, so as to fasten the first connecting member 30 with the second connecting member 40.

The stopper 52 is integrally extended from the first member head portion 31 of the first connecting member 30 wherein the stopper 52 is adapted for blocking up the end shoulder the sleeve locker 51 in such a slidably movable manner along the first member head portion 31, so as to prevent the sleeve locker 51 sliding out of the first connecting member 30. Furthermore, since the stopper 52 blocks up the sleeve locker 51 in a slidably movable manner along the first member head portion 31, when the stopper 52 screws with the tubular shelter 43, the connection between first connecting member 30 and the second connecting member 40 will be adjustably tight enough.

What is claimed is:

1. A ropelight connector for connecting a first ropelight with a second ropelight, comprising:

a first connecting member having a first member head portion and a first member tail portion affixed to an end of said first ropelight wherein a pair of parallel locking sockets is longitudinally formed on said first member head portion and a pair of tubular conductor, which are electrically extended from a pair of wires inside said first ropelight respectively, outwardly protruded from said first member head portion along said locking sockets respectively;

a second connecting member, having a second member head portion and a second member tail portion affixed to an end of said second ropelight, comprising a tubular shelter frame coaxially extended from said second member head portion wherein a pair of conductive terminals, which are electrically connected to a pair of wires inside said second ropelight, are outwardly extended from said second member head portion and adapted for fittingly inserting into said locking sockets to engage with said tubular conductors respectively for securely connecting said second connecting member with said first connecting member, so as to electrically connecting said first and second ropelights together; and a locking means comprising a sleeve locker slidably wearing on said first connecting member and a ring-shaped stopper for blocking an inwardly projected end shoulder of said sleeve locker in such a slidably movable manner along said first connecting member, wherein said sleeve locker, which has a diameter slightly larger than a diameter of said tubular shelter, has an inner threaded portion for screwing with an outer threaded portion of said tubular shelter, so as to fasten said first connecting member with said second connecting member.

2. A ropelight connector, as recited in claim 1, wherein said first member tail portion of said first connecting member and said second member tail portion of said second connecting member are respectively tubular holders, each of which having a diameter slightly larger than a diameter of said respective ropelight, wherein said tubular holders are securely affixed to said ends of said first and second ropelights in such an air tight manner, so as to permanently connect said first connecting member and said second connecting member to said first ropelight and said second ropelight respectively.

3. A ropelight connector, as recited in claim 1, wherein said tubular shelter is integrally extended from said second member head portion of said second connecting member and encircling said conductive terminals for protecting thereof, wherein said tubular shelter has a diameter slightly larger than a diameter of said first member head portion for fittingly receiving said first member head portion therein.

4. A ropelight connector, as recited in claim 2, wherein said tubular shelter is integrally extended from said second member head portion of said second connecting member and encircling said conductive terminals for protecting thereof, wherein said tubular shelter has a diameter slightly larger than a diameter of said first member head portion for fittingly receiving said first member head portion therein.

5. A ropelight connector, as recited in claim 1, wherein said locking sockets are elongated locking sockets and said conductive terminals are rod-like conductive terminals having a size fittingly inserting into said locking sockets respectively.

6. A ropelight connector, as recited in claim 2, wherein said locking sockets are elongated locking sockets and said conductive terminals are rod-like conductive terminals having a size fittingly inserting into said locking sockets respectively.

7. A ropelight connector, as recited in claim 3, wherein said locking sockets are elongated locking sockets and said conductive terminals are rod-like conductive terminals having a size fittingly inserting into said locking sockets respectively.

8. A ropelight connector, as recited in claim 4, wherein said locking sockets are elongated locking sockets and said conductive terminals are rod-like conductive terminals having a size fittingly inserting into said locking sockets respectively.

* * * * *

US006379190C1

(12) EX PARTE REEXAMINATION CERTIFICATE (6736th)

United States Patent

Prazoff

(10) Number: US 6,379,190 C1

(45) Certificate Issued: Mar. 31, 2009

(54) ROPELIGHT CONNECTOR

(76) Inventor: Michael Prazoff, 555 Chabanel St. West Ste #700, Montreal, Quebec (CA), H2H-2J2

Reexamination Request:
No. 90/006,327, Jul. 17, 2002
No. 90/006,328, Jul. 18, 2002
No. 90/006,344, Aug. 1, 2002

Reexamination Certificate for:

| | |
|---|---|
| Patent No.: | **6,379,190** |
| Issued: | **Apr. 30, 2002** |
| Appl. No.: | **09/714,563** |
| Filed: | **Nov. 17, 2000** |

(51) Int. Cl.
*H01R 25/00* (2006.01)

(52) U.S. Cl. ..... 439/654; 439/320; 362/249

(58) Field of Classification Search ..... None
See application file for complete search history.

(56) References Cited

U.S. PATENT DOCUMENTS

| | | | | | |
|---|---|---|---|---|---|
| 2,409,004 | A | | 10/1946 | Wall | 439/281 |
| 2,449,983 | A | | 9/1948 | Devol | 174/88 C |
| 2,731,610 | A | | 1/1956 | Thacker | 439/321 |
| 2,866,957 | A | | 12/1958 | Raypholtz | 439/246 |
| 2,962,688 | A | | 11/1960 | Werner | 439/320 |
| 3,775,828 | A | | 12/1973 | Kopenhaver | 291/859 |
| 3,885,849 | A | | 5/1975 | Bailey et al. | 439/518 |
| 4,090,759 | A | | 5/1978 | Herrmann, Jr. | 439/281 |
| 4,426,124 | A | | 1/1984 | Vandevier | 439/271 |
| 4,514,784 | A | | 4/1985 | Williams et al. | 361/716 |
| 4,607,317 | A | | 8/1986 | Lin | 362/249 |
| 4,812,956 | A | * | 3/1989 | Chen | 362/249 |
| 5,150,964 | A | * | 9/1992 | Tsui | 362/251 |
| 5,304,073 | A | | 4/1994 | Golobay et al. | 439/282 |
| 5,688,041 | A | | 11/1997 | Arndt | 362/226 |
| 5,836,778 | A | | 11/1998 | Fan | 439/235 |
| 5,906,513 | A | | 5/1999 | Peterson et al. | 439/607 |
| 5,934,792 | A | | 8/1999 | Camarota | 362/249 |
| 5,964,518 | A | | 10/1999 | Shen | 362/225 |
| 5,984,724 | A | | 11/1999 | McNeel | 439/606 |
| 6,030,241 | A | | 2/2000 | Chiba | 439/222 |
| 6,394,623 | B1 | * | 5/2002 | Tsui | 362/249 |

OTHER PUBLICATIONS

Letter from Robert J. Rose dated Aug. 1, 2002.

* cited by examiner

*Primary Examiner*—My-Trang Ton

(57) ABSTRACT

A ropelight connector adapted for securely connecting two ropelights together includes a first connecting member affixed to a first ropelight and a second connecting member affixed to a second ropelight wherein the first connecting member is detachably connected to the second connecting member. The first connecting member includes a pair of locking sockets and a pair of tubular conductors fittedly received in the locking sockets respectively wherein the tubular conductors are electrically connected to a pair of wires inside the first ropelight. The second connecting member includes a pair of conductive terminals, which are electrically extended from a pair of wires inside the second ropelight, protruded from the second connecting member and a tubular shelter outwardly extended from the second connecting member for protecting the conductive terminals. In which, the conductive terminals are adapted for fittingly inserting into the locking sockets to engage with the tubular conductors respectively for securely connecting the second connecting member with the first connecting member, so as to electrically connecting the first and second ropelights together.

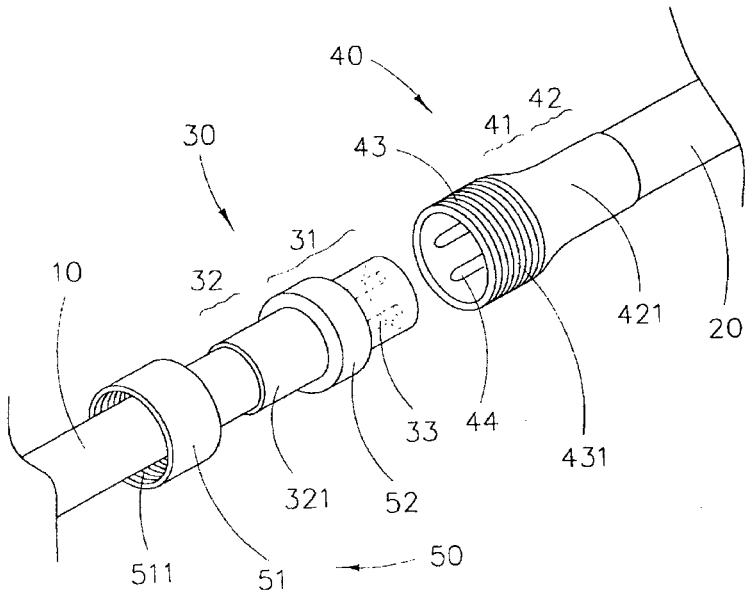

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–8 are cancelled.

* * * * *